US005875577A

United States Patent [19]

Lu

[11] Patent Number: 5,875,577

[45] Date of Patent: Mar. 2, 1999

[54] BALL ORNAMENT WITH A ROTARY STRUCTURE

[76] Inventor: Chin-Shu Lu, 7th Fl., 437, Yen Ping Road, Sec. 3, Hsinchu, Taiwan

[21] Appl. No.: 59,588

[22] Filed: Apr. 14, 1998

[51] Int. Cl.[6] ..... G09F 19/08

[52] U.S. Cl. ..... 40/411; 40/410

[58] Field of Search ..... 40/409, 410, 411, 40/430

[56] References Cited

U.S. PATENT DOCUMENTS

| | | | |
|---|---|---|---|
| 5,088,218 | 2/1992 | Liu | 40/411 |
| 5,456,031 | 10/1995 | Hou | 40/411 |
| 5,675,921 | 10/1997 | Lin | 40/411 |

*Primary Examiner*—Cassandra H. Davis
*Attorney, Agent, or Firm*—Rosenberg, Klein & Bilker

[57] ABSTRACT

A ball ornament with a rotary structure including a rubber fitting ring, a coupling seat, a positioning seat, a revolving disk, a transparent ball shell, and a base. The fitting ring is centrally provided with a receiving hole, and the coupling seat is received in the receiving hole of the fitting ring in tight fit and is provided with positioning posts and a central stepped coupling hole for receiving a silicon packing ring. The positioning seat is located below the rubber fitting ring and insertably connected to the positioning posts of the coupling seat. It positions a motor. The revolving disk is mounted on the coupling seat and linked-up with an output shaft of the motor by a connecting sleeve. The ball shell is provided with a curved positioning flange at a bottom end for engaging the positioning flange of the fitting ring and placed on the base. It is filled with a liquid in advance. Assembly of the ball ornament is simple and quick, and rotation thereof is smooth without problem of leakage.

2 Claims, 4 Drawing Sheets

BALL ORNAMENT WITH A ROTARY STRUCTURE

BACKGROUND OF THE INVENTION (a) Field of the Invention

The present invention relates generally to a ball ornament with a rotary structure, and more particularly to a ball ornament with a rotary structure that is simple and quick to assemble, performs smooth rotation, and has zero leakage.

(b) Description of the Prior Art

In conventional ball ornaments or water ball ornaments, the ornament inside the ball is generally fixed and cannot rotate to give a lively scene. This is because it requires a high level of technique to enable the ornament to move in an environment of water, and there is the problem of possible water leakage. Some manufacturers have attempted to make water ball ornaments with revolving ornaments but failed. They are either too complicated in construction or the manufacturing process thereof is too complex, which leads to high costs. Besides, the quality of the products is not good. There is also the problem of water leakage.

The water ball ornaments respectively disclosed in U.S. Pat. Nos. 5,655,321 and 4,757,986 have advantages as well as disadvantages. As a whole, they suffer from the drawbacks of difficult assembly and water leakage.

SUMMARY OF THE INVENTION

A primary object of the present invention is to provide a ball ornament with a rotary structure that is simple and quick to assemble, allows smooth rotation, and ensures water-tightness.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
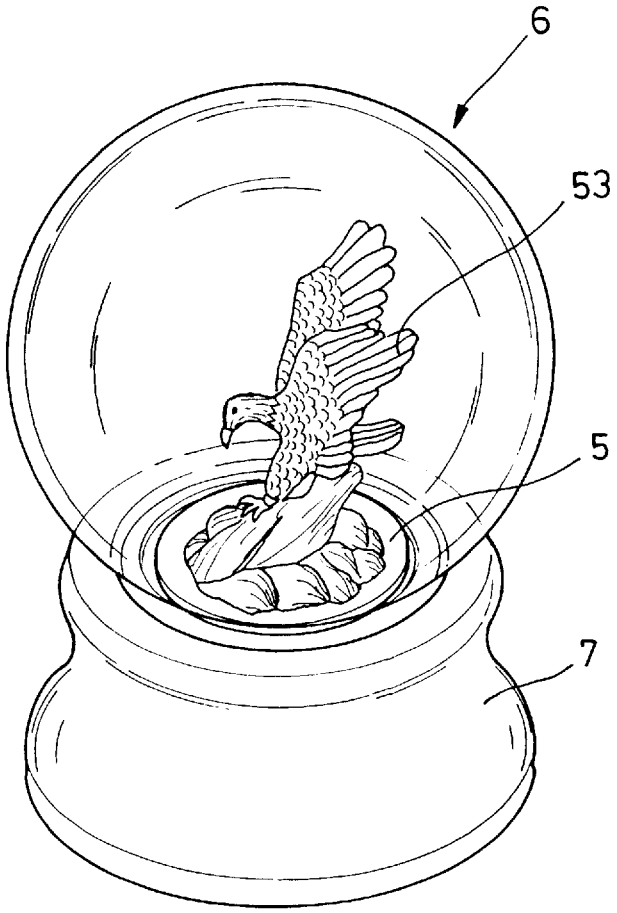
FIG. 1 is an elevational view of the present invention.
Figure 2:
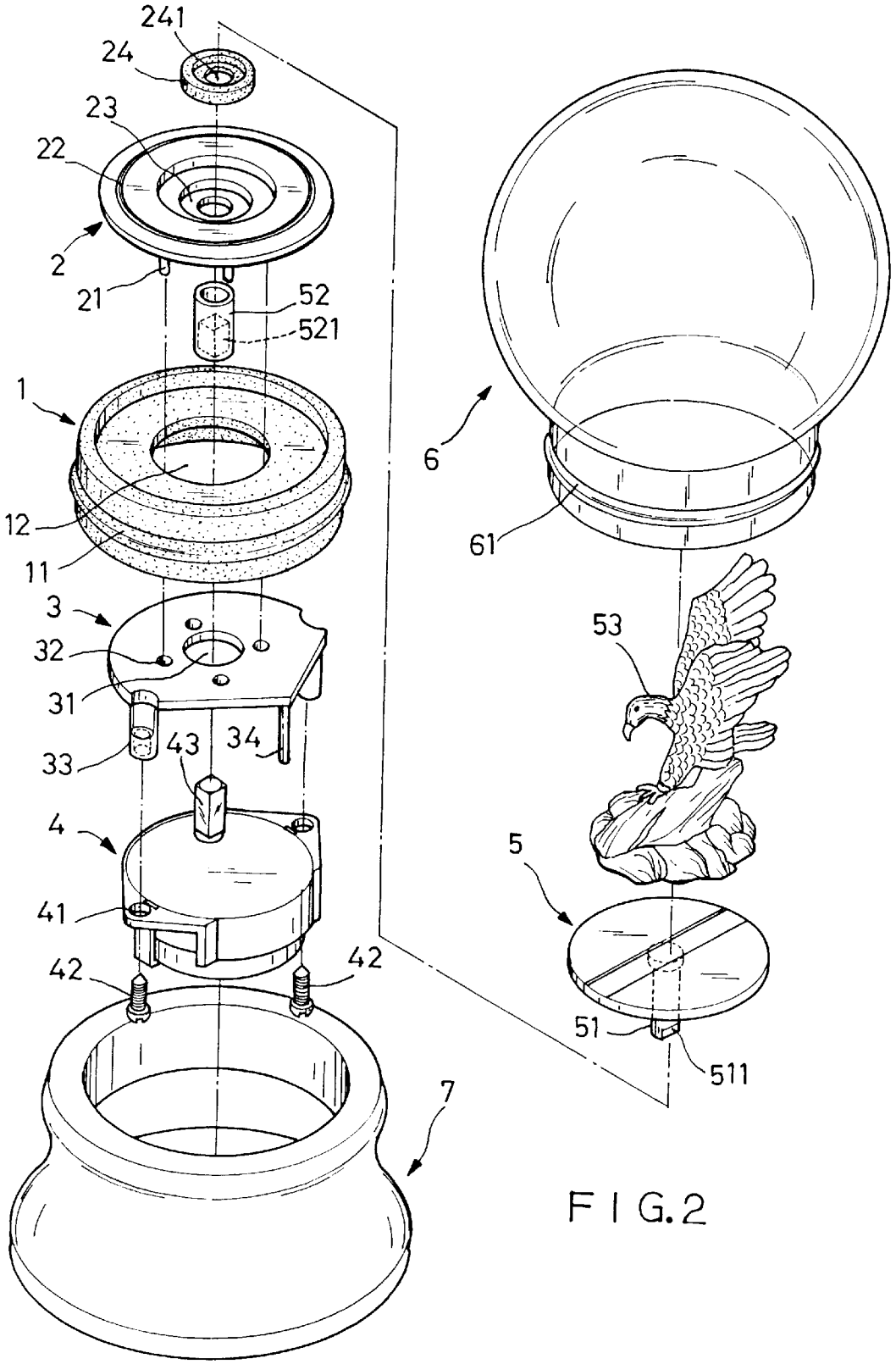
FIG. 2 is a perspective view of the present invention.
Figure 3:
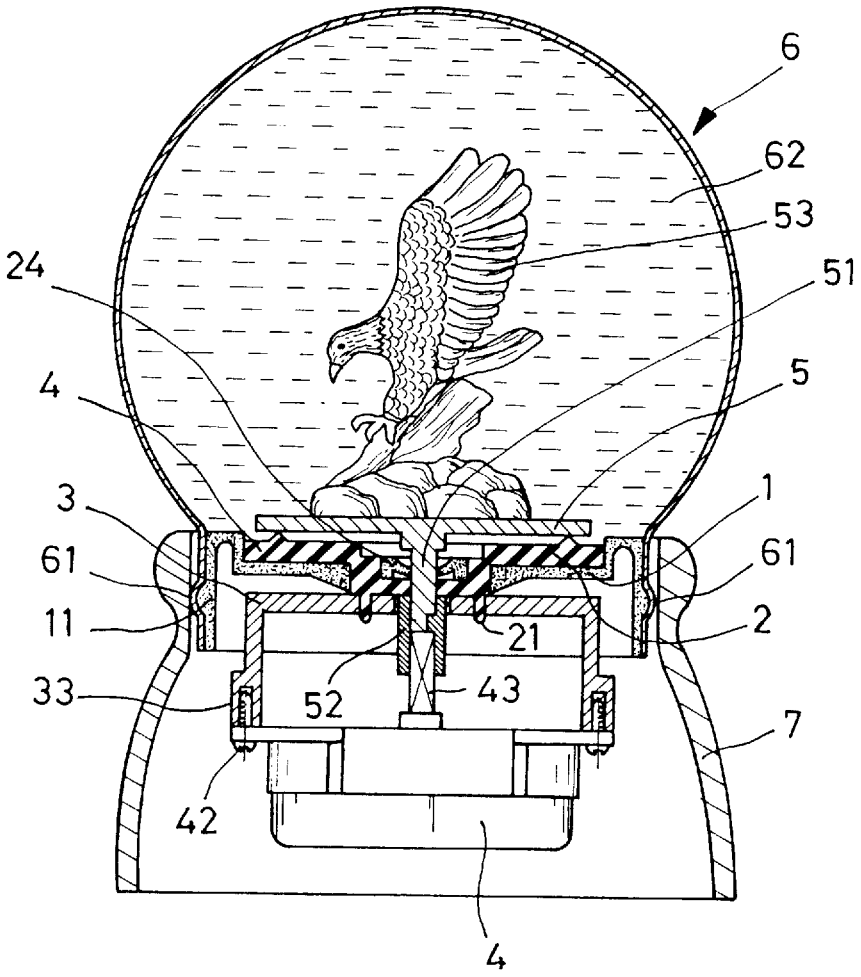
FIG. 3 is a sectional view of the present invention.

With reference to the drawings, the present invention essentially a rubber fitting ring 1, a coupling seat, 2, a positioning seat 3, a small motor 4, a revolving disk 5, a transparent ball shell 6, and a base 7.

The rubber fitting ring 1 is provided with a positioning flange 11 at the outer side of its surrounding wall, and a stepped receiving hole 12 at its center.

The coupling seat 2 is disposed in the receiving hole 12 of the rubber fitting ring 1 in tight fit. It is provided with a plurality of positioning posts 21 at a lower side thereof, a conical raised urging ring 22 at an upper side thereof, a stepped coupling hole 23 in its center, and a silicon packing ring 24 planted in the coupling hole 23.

The positioning seat 3 is disposed below the rubber fitting ring 1. It is provided with a through hole 31 at substantially the center thereof. A plurality of insert holes 32 are arranged around the through hole 31 corresponding to and receiving the insert posts 21 of the coupling seat 2. The positioning seat 3 further has coupling posts 33 respectively extending downwardly from a lower side thereof at two opposite ends. There are also provided positioning posts 34 of equal height extending downwardly from the lower side at the other two opposite ends.

The small motor 4 is provided with positioning holes 41 corresponding to the coupling posts 33 of the positioning seat 3 so that bolts 42 can be used to lock the small motor 4 to the bottom side of the positioning seat 3. Furthermore, the small motor 4 has an output shaft 43 which is not cylindrical.

The revolving disk 5 is mounted at the upper side of the coupling seat 2 and includes a rotary shaft 51 at a bottom side thereof which passes through the packing ring 24 planted in the coupling seat 2, and a connecting sleeve 52 connected to the output shaft 43 of the motor 4 in a linking-up relationship. An ornament 53 is further disposed on an upper side of the revolving disk 5.

The transparent ball shell 6 includes a ball portion having an opening and an annular connecting portion below the ball portion. The outer wall of the annular connecting portion is provided with a curved positioning flange 61 for insertably positioning the positioning flange 11 of the rubber fitting ring 1. The ball shell 6 is filled with a liquid 62 in advance.

The base 7 houses the above-mentioned components with the ball shell 6 placed on top thereof.

Figure 5:
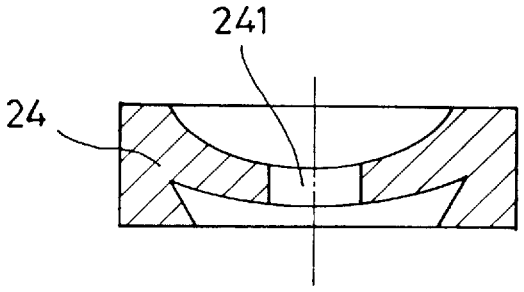
FIG. 5 is a sectional view of the packing ring according to the present invention.

In assembly, the coupling scat 2 is positioned in the stepped receiving hole 12 of the rubber fitting ring I in tight fit so as to seal the receiving hole. Then The revolving disk 5 and the ornament 53 disposed thereon are placed on the coupling seat 2. At this point, the rotary shaft 51 of the revolving disk 5 extends through the packing ring 24 to expose on the bottom side of the coupling seat 2. Subsequently, the ball shell 6 is immersed in the liquid 62 with its opening on top. The rubber fitting ring 1 is then fitted into the annular connecting portion of the ball shell 6 such that the positioning flange 11 engages the curved positioning flange 61 of the ball shell. At this point, the rubber fitting ring 1 will have sealed the opening of the ball shell 6 to avoid leakage of water from the ball shell 6. The biggest problem with this leakage-proof design is that the location of the rotary shaft 51. In order not to affect rotation of the rotary shaft 51, the silicon packing ring 24 is planted in the coupling hole 23 of the coupling seat 2. Silicon has excellent elasticity and sealing effects. In the present invention, to match the characteristic of the rotary shaft 51, the packing ring 24 is configured to have the shape as shown in FIG. 5. As shown, the center of the packing ring 24, i.e., where the rotary shaft passes through, is configured to be a curved portion of a smaller thickness, and the center of the curved portion is provided with a round hole 241. Such a configuration will prevent the rotary shaft 51 from damaging the packing ring 24 when passing therethrough. Besides, the round hole 241 is configured to fit the size of the rotary shaft 51 so as to prevent leakage. If the thickness at that portion is too large, then the rotation of the rotary shaft 51 will be made more difficult and the elasticity of the packing ring 24 reduced, thereby affecting the sealing effects. It can therefore appreciated that the packing ring 24 with its round hole 241 provides excellent elasticity and positively prevents leakage from the edge of the rotary shaft 51. Besides, the rotary shaft 51 will not be come stuck.

Figure 4:
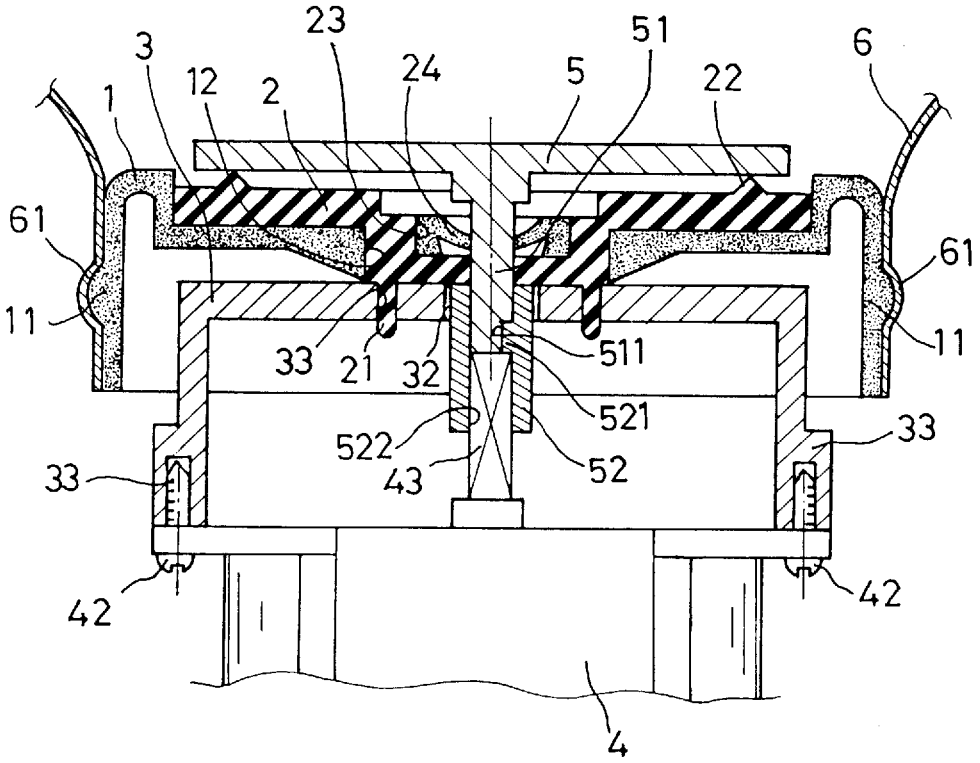
FIG. 4 is an enlarged sectional view of the present invention in part.

Furthermore, the output shaft 43 of the small motor 4, as mentioned above, is not cylindrical. Likewise, the connecting sleeve 52 has a non-cylindrical fitting hole 521 at a bottom end thereof so that the output shaft 42 may smoothly drive the connecting sleeve 52 to rotate therewith. Additionally, the upper end of the connecting sleeve 52 has a round hole, the bottom side of which is, as shown in FIG. 4, provided with a projection 521 for engaging a sunken plane 511 at the bottom end of the rotary shaft 51, whereby the revolving disk 5 may be smoothly rotated.

In the present invention as described above, the small motor 4 may utilize the connecting sleeve 52 to transmit power to the revolving disk 5 to cause the ornament 53 thereon to rotate. The modular design of the present invention makes the connection among the components very simple and quick. Only the raised urging ring 22 is utilized to provide an upward urging force of point contact, so that the rotational friction is extremely low, thereby enabling smooth rotation. Furthermore, since the coupling seat 2 is fittingly received in the receiving hole 12 of the rubber fitting ring 1, and the rotary shaft 51 of the revolving disk 5 is also in tight fit with the packing ring 24, combined with the elasticity and fitness provided by the silicon packing ring 24, the rotary shaft 51 may always be in a fittingly tight relationship with the packing ring 24 during rotation.

To repeat, the modularization of the ornamental ball and the low rotational friction achievable by the present invention, as well as the water-tightness design, enable the present invention to have the advantages of simple and quick assembly, smooth rotation, and positive proof against leakage.

Although the present invention has been illustrated and described with reference to the preferred embodiment thereof, it should be understood that it is in no way limited to the details of such embodiment but is capable of numerous modifications within the scope of the appended claims.

What is claimed is:

1. A ball ornament with a rotary structure, comprising:

a rubber fitting ring provided with a positioning flange at an outer side of a surrounding wall thereof, and a stepped receiving hole at a center portion thereof;

a coupling seat disposed in said receiving hole of said rubber fitting ring in tight fit, said coupling seat including a plurality of insert posts at a lower side thereof, a conical raised urging ring at an upper side thereof, a stepped coupling hole in its center, and a silicon packing ring planted in said coupling hole;

a positioning seat disposed below said rubber fitting ring, said positioning seat being provided with a through hole at substantially the center thereof, a plurality of insert holes arranged around said through hole corresponding to and receiving said insert posts of said coupling seat, coupling posts respectively extending downwardly from a lower side of said positioning seat at two opposite ends, and positioning posts of equal height extending downwardly from the lower side at two other ends thereof;

a small motor provided with positioning holes corresponding to said coupling posts of said positioning seat so that bolts can be used to lock said small motor to the lower side of said positioning seat, said small motor further having an output shaft which is not cylindrical;

a revolving disk mounted at the upper side of said coupling seat and including a rotary shaft at a bottom side thereof which passes through said packing ring planted in said coupling seat, a connecting sleeve connected to said output shaft of said small motor in a linking-up relationship, and an ornament disposed on an upper side of said revolving disk;

a transparent ball shell including a ball portion having an opening and an annular connecting portion below said ball portion, said annular connecting portion having an outer wall provided with a curved positioning flange for insertably positioning said positioning flange of said rubber fitting ring, said shell being filled with a liquid in advance; and a base that houses said rubber fitting ring, said positioning seat, and said small motor, and receiving said ball shell on a top portion thereof.

2. The ball ornament as defined in claim 1, wherein said packing ring is formed to have a curved portion of a relatively small thickness at its center, said curved portion being centrally provided with a round hole.

* * * * *